US009249648B2

(12) United States Patent
Lehr

(10) Patent No.: US 9,249,648 B2
(45) Date of Patent: Feb. 2, 2016

(54) CONTINUOUS CIRCULATION AND COMMUNICATION DRILLING SYSTEM

(71) Applicant: BAKER HUGHES INCORPORATED, Houston, TX (US)

(72) Inventor: Joerg Lehr, Lower Saxony (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 370 days.

(21) Appl. No.: 13/760,817

(22) Filed: Feb. 6, 2013

(65) Prior Publication Data

US 2014/0216816 A1 Aug. 7, 2014

(51) Int. Cl.

| | |
|---|---|
| ***E21B 21/10*** | (2006.01) |
| ***E21B 34/06*** | (2006.01) |
| ***E21B 47/12*** | (2012.01) |
| ***E21B 21/08*** | (2006.01) |
| *E21B 21/00* | (2006.01) |

(52) U.S. Cl.

CPC ..... *E21B 34/06* (2013.01); *E21B 21/08* (2013.01); *E21B 21/10* (2013.01); *E21B 21/103* (2013.01); *E21B 47/12* (2013.01); *E21B 2021/006* (2013.01)

(58) Field of Classification Search

CPC ..... E21B 17/18; E21B 17/16; E21B 21/10; E21B 21/12; E21B 34/16

See application file for complete search history.

(56) References Cited

U.S. PATENT DOCUMENTS

| | | | |
|---|---|---|---|
| 1,491,986 | A | 4/1924 | Greene |
| 2,102,555 | A | 12/1937 | Dyer |
| 2,158,356 | A | 5/1939 | Dyer |
| 2,522,444 | A | 9/1950 | Grable |
| 3,078,921 | A | 2/1963 | Edwards |
| 3,298,385 | A | 1/1967 | Jackson et al. |
| 4,310,050 | A | 1/1982 | Bourgoyne, Jr. |
| 4,448,267 | A | 5/1984 | Crawford, III et al. |
| 4,646,844 | A | 3/1987 | Roche et al. |
| 4,768,598 | A | 9/1988 | Reinhardt |
| 5,332,044 | A | 7/1994 | Dallas et al. |
| 5,584,343 | A | 12/1996 | Coone |
| 6,253,861 | B1 | 7/2001 | Carmichael et al. |
| 6,315,051 | B1 | 11/2001 | Ayling |
| 6,412,554 | B1 | 7/2002 | Allen et al. |
| 6,581,692 | B1 | 6/2003 | Koch et al. |
| 6,591,916 | B1 | 7/2003 | Ayling |

(Continued)

FOREIGN PATENT DOCUMENTS

| | | | |
|---|---|---|---|
| AU | 2011293656 | A1 | 1/2013 |
| WO | 2012010480 | A2 | 1/2012 |
| WO | 2012012632 | A1 | 1/2012 |

OTHER PUBLICATIONS

PCT/US2014/015041—International Search Report and Written Opinion mailed Jun. 3, 2014.

*Primary Examiner* — Brad Harcourt

(74) *Attorney, Agent, or Firm* — Mossman, Kumar & Tyler PC

(57) ABSTRACT

An apparatus for performing a wellbore operation includes a drill string having a rigid tubular section formed of a plurality of jointed tubulars and a plurality of valves positioned along the rigid tubular section. Each valve may have a radial valve controlling flow through a wall of the rigid tubular section and a signal relay device configured to convey information-encoded signals. Wellbore operations may be performed by transmitting signals using the signal relay devices.

20 Claims, 3 Drawing Sheets

(56) References Cited

U.S. PATENT DOCUMENTS

| | | | | |
|---|---|---|---|---|
| 6,688,394 | B1 | 2/2004 | Ayling | |
| 6,717,501 | B2 * | 4/2004 | Hall et al. | 336/132 |
| 6,739,397 | B2 | 5/2004 | Ayling | |
| 6,938,709 | B2 | 9/2005 | Juhasz et al. | |
| 7,028,787 | B2 | 4/2006 | Allen et al. | |
| 7,107,875 | B2 | 9/2006 | Haugen et al. | |
| 7,134,489 | B2 | 11/2006 | Van Riet | |
| 7,188,683 | B2 | 3/2007 | Ayling | |
| 7,252,151 | B2 | 8/2007 | Ayling | |
| 7,281,582 | B2 | 10/2007 | Robichaux et al. | |
| 7,322,418 | B2 | 1/2008 | Ayling | |
| 7,350,587 | B2 | 4/2008 | Springett et al. | |
| 7,413,008 | B2 | 8/2008 | Basso et al. | |
| 7,510,006 | B2 | 3/2009 | Juhasz et al. | |
| 2003/0066650 | A1 | 4/2003 | Fontana et al. | |
| 2006/0254822 | A1 | 11/2006 | Ayling et al. | |
| 2006/0278434 | A1 | 12/2006 | Calderoni et al. | |
| 2007/0067804 | A1 * | 3/2007 | Six et al. | 725/58 |
| 2007/0278007 | A1 * | 12/2007 | Krueger et al. | 175/25 |
| 2009/0025930 | A1 | 1/2009 | Iblings et al. | |
| 2009/0114398 | A1 | 5/2009 | Buytaert et al. | |
| 2009/0236144 | A1 * | 9/2009 | Todd et al. | 175/5 |
| 2011/0067923 | A1 | 3/2011 | Leuchtenberg | |
| 2011/0308860 | A1 * | 12/2011 | deBoer | 175/57 |
| 2012/0181043 | A1 | 7/2012 | Patel | |
| 2012/0205122 | A1 | 8/2012 | Peter et al. | |
| 2013/0014991 | A1 | 1/2013 | Leuchtenberg | |
| 2013/0014993 | A1 | 1/2013 | Jeffries | |
| 2013/0047696 | A1 | 2/2013 | Rasmus et al. | |

* cited by examiner

CONTINUOUS CIRCULATION AND COMMUNICATION DRILLING SYSTEM

CROSS-REFERENCE TO RELATED APPLICATIONS

None.

BACKGROUND OF THE DISCLOSURE

1. Field of the Disclosure

This disclosure relates generally to oilfield systems for managing wellbore pressure.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." During drilling, wellbore pressure management may be used to control events such as pressure spikes and other undesirable conditions.

In aspects, the present disclosure provides enhanced methods and systems for managing wellbore pressure.

SUMMARY OF THE DISCLOSURE

In aspects, the present disclosure provides an apparatus for performing a wellbore operation. The apparatus may include a drill string having a rigid tubular section formed of a plurality of jointed tubulars and a plurality of flow diverters positioned along the rigid tubular section. Each flow diverter may have a radial valve controlling flow through a wall of the rigid tubular section and a signal relay device configured to convey information-encoded signals.

In aspects, the present disclosure also provides a method for performing a wellbore operation using a drill string that includes jointed tubulars. The method may include adding a plurality of flow diverters to the drill string, wherein each flow diverter has: (i) a valve controlling radial flow through a wall of the drill string, and (ii) a signal relay device configured to relay signals; conveying the drill string along a wellbore; and transmitting signals along the drill string using the signal relay devices.

Examples of certain features of the disclosure have been summarized in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a system for deep drilling (e.g., tight pressure windows) and drilling into formations with changing formation pressure (e.g., depleted zones). Systems according to the present disclosure provide ECD control (equivalent circulating density control) for such situations. These systems may allow the exploration and production of deep high enthalpy geothermal energy due to the ability to manage tight pressure windows in deep crystalline rock.

Illustrative embodiments of the present disclosure use "real time" or near "real time" data acquisition to monitor pressure conditions in a well and implement corrective action when needed. The systems may use a drill string that includes one or more signal conveying devices that cooperate with a communication network to retrieve wellbore parameter information and transmit control signals to downhole well control equipment. In one embodiment, the signal conveying devices may be integrated into the flow diverters used with a continuous circulation system that circulates drilling fluid in the well. These and other embodiments are discussed in greater detail below.

Figure 1:
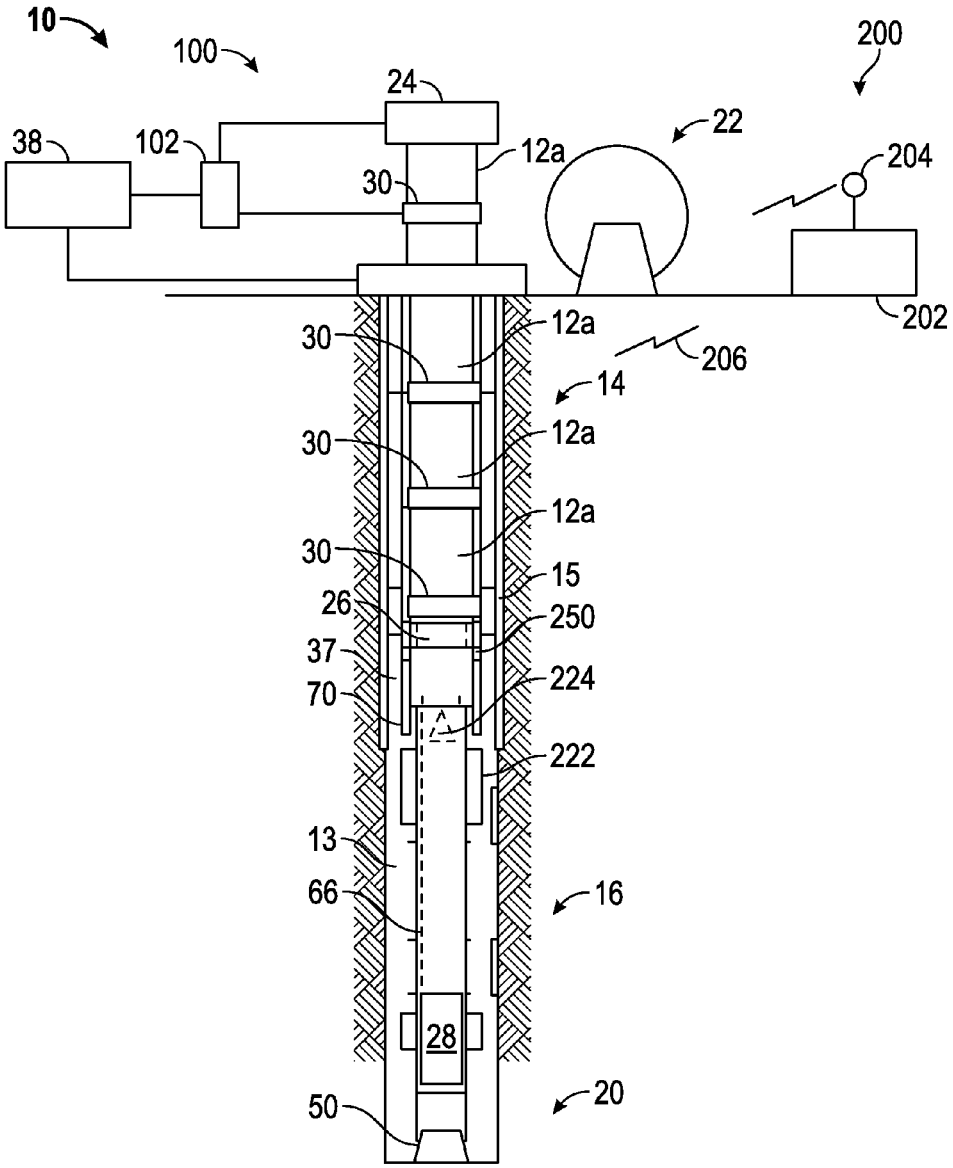
FIG. 1 schematically illustrates an exemplary wellbore construction system made in accordance with one embodiment of the present disclosure.

Referring initially to FIG. 1, there is shown a system 10 in accordance with one embodiment of the present disclosure. The system 10 includes a drill string 11 and a bottomhole assembly (BHA) 20. In one embodiment, the drill string 11 may be made up of a section of rigid tubulars 14 (e.g., jointed tubular). In other embodiments, the drill string 11 may be made up of a rigid tubular section 14 and a non-rigid tubular string 16 (e.g., coiled tubing). As used herein, the term rigid and non-rigid are used in the relative sense to indicate that the strings 14 and 16 exhibit different responses to an applied loading. For instance, an applied torque that a jointed tubular can readily transmit may cause coiled tubing to fail. In one sense, a non-rigid tubular may be a continuous tubular that may be coiled and uncoiled from a reel or drum (i.e., 'coilable') 22 whereas a rigid tubular string may include segmented joints that may be manipulated by a top drive 24. The system 10 may also include rotary power devices 26, 28 (e.g., mud motors, electric motors, turbines for rotating one or more portions of the string 11, etc.). Rotary power for the drill bit 50 may be generated by a motor 26 at a connection between the rigid string 14 and the non-rigid string 16, a near bit motor 28, and/or the surface top drive 24.

Figure 2:
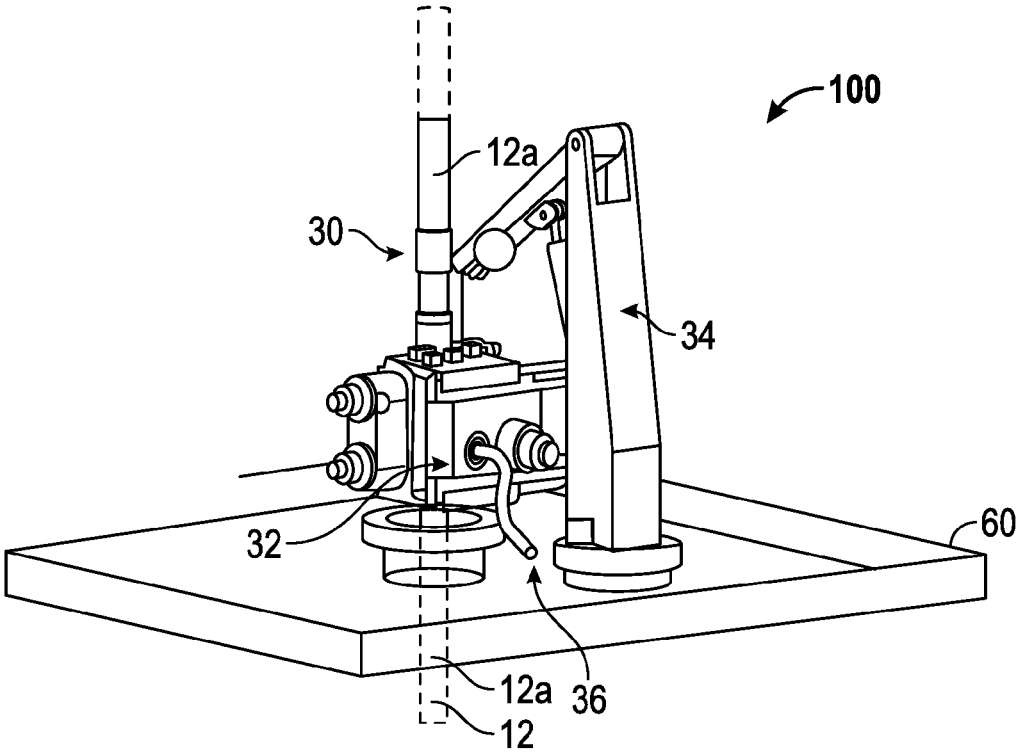
FIG. 2 schematically illustrates a continuous circulation system that may be used with the FIG. 1 system.

Referring now to FIG. 2, the system 10 includes a continuous circulation system 100 (CCS 100) that maintains continuous drill mud circulation in the drill string 11 as jointed connections are made up or broken in the rigid tubular section 14. The CCS 100 may include a flow diverter control device 32, an arm 34, a fluid line 36, and a manifold 102. During operation, the CCS 100 uses the manifold 102 to selectively direct drilling fluid to either the top drive 24 or the flow diverters 30 that interconnect the pipe stands 12*a* of the rigid tubular section 14 of the drill string 11.

For example, during drilling, the manifold 102 directs drilling fluid into the top drive 24. To add a pipe stand 12*a*, drilling is stopped and the arm 34 moves the flow diverter control device 32 into engagement with a flow diverter 30. This engagement activates valves internal to the flow diverter 30 that block axial flow from top drive 24 and allow radial from the flow diverter control device 32. Thereafter, the manifold 102 switches drilling fluid flow from the top drive 24 to the fluid line 36, which flows drilling fluid from the source 38 to the flow diverter control device 32. The flow diverter control device 32 supplies the flow diverter 30 with pressurized fluid. The top drive 24 (FIG. 1) and an upper pipe stand 12*a* are now isolated from the drill string 11 and can be disconnected from the rigid string section 14. Thus, drilling fluid is continuously supplied to the wellbore 13 even when the drill string 11 is not connected to the top drive 24.

In other embodiments, the BHA 20 may include devices that enhance drilling efficiency or allow for directional drilling. For instance, the BHA 20 may include a thruster that applies a thrust to urge the drill bit 50 against a wellbore bottom. In this instance, the thrust functions as the weight-on-bit (WOB) that would often be created by the weight of the drill string. It should be appreciated that generating the WOB using the thruster reduces the compressive forces applied to the non-rigid string 16. One or more stabilizers that may be selectively clamped to the wall may be configured to have thrust-bearing capabilities to take up the reaction forces caused by the thruster. Moreover, the thruster allows for drilling in non-vertical wellbore trajectories where there may be insufficient WOB to keep the drill bit 50 pressed against the wellbore bottom. Some embodiments of the BHA 20 may also include a steering device. Suitable steering arrangements may include, but are not limited to, bent subs, drilling motors with bent housings, selectively eccentric inflatable stabilizers, a pad-type steering devices that apply force to a wellbore wall, "point the bit" steering systems, etc. As discussed previously, stabilizers 26 may be used to stabilize and strengthen the strings 14, 16.

Figure 3:
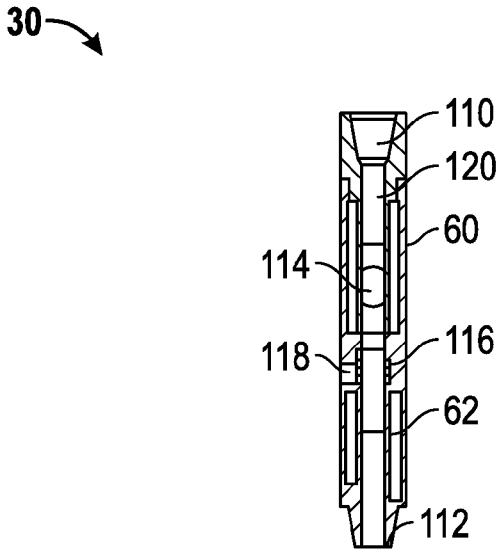
FIG. 3 schematically illustrates a flow diverter that may be used with the continuous circulation system of FIG. 2.

Referring now to FIG. 3, the flow diverter 30 includes an upper end 110 and a lower end 112. The flow diverter 30 may be fitted with flow control devices that allow fluid communication to the lower end 112 via either the upper end 110 or a radial/lateral opening. In one embodiment, the flow diverter 30 may include an upper circulation valve 114, a lower circulation valve 116, and an inlet 118. The upper circulation valve 114 selectively blocks flow along a bore 120 connecting the upper and lower ends 110, 112. The lower circulation valve 116 selectively blocks flow between the bore 120 and the inlet 118. The flow diverter control device 32 (FIG. 2) may include a valve actuator (not shown) that can shift the upper circulation valve 114 between an open and a closed position and a lower valve actuator (not shown) that can shift the lower circulation valve 116 between an open and a closed position. It should be appreciated that the CCS 100 has two separate fluid paths that can independently circulate drilling fluid into the drill string 11 (FIG. 1). The first fluid path is formed when the upper circulation valve 114 is open and the lower circulation valve 116 is closed. In this axial flow path, drilling fluid flows along the bore 120 from the upper end 110 to the lower end 112. The second fluid path is formed when the upper circulation valve 114 is closed and the lower circulation valve 116 is open. In this radial or lateral flow path, the drilling fluid flows along from the line 36 (FIG. 2), across the inlet 118, into the bore 120, and down to the lower end 112.

The flow diverter 30 may also be configured to convey signals along the wellbore 13 (FIG. 1). The signals may be conveyed in either the uphole or downhole direction. The signals may be encoded with information for monitoring downhole pressure conditions and activating wellbore equipment used to manage one or more pressure parameters. In one embodiment, the flow diverter 30 may include a short-hop telemetry module that includes a signal relay device 60 energized by a power source 62. The signal relay device 60 may be embedded in the flow diverter 30 or fixed to the flow diverter 30 in any other suitable manner. The signal relay device 60 includes a suitable transceiver for receiving and transmitting data signals. For example, the signal relay device 60 can include an antenna arrangement through which the electromagnetic signals are sent and received through a short hop communication link. One non-limiting embodiment may include radio frequency (RF) signals. The signal relay device 60 is a component of a two-way telemetry system that can transmit signals (data and/or control) to the surface and/or downhole. In an exemplary short-hop telemetry system, data is transmitted from one relay point to an immediately adjacent relay point, or a relay point some distance away. In other embodiments, other waves may be used to transmit signals, e.g., acoustical waves, pressure pulses, etc.

Referring back to FIG. 1, a communication system 200 uses the signal relay devices 60 (FIG. 3) as part of a communication link with downhole equipment positioned along the drill string 11 (FIG. 1). Additionally or alternatively, the signal relay devices may be included in wellbore equipment, such as a casing 15 (FIG. 1). Illustrative wellbore equipment, include, but are not limited to, casings, liners, casing collars, casing shoes, devices embedded in the formation, conduits (e.g., hydraulic tubing, electrical cables, pipes, etc.). The downhole communication link also includes a signal carrier 66 disposed along the non-rigid carrier 16. The signal carrier 66 may be metal wire, optical fibers, customized cement or any other suitable carrier for conveying information-containing signals. The signal carrier 66 may be embedded in the wall of the non-rigid string 16 or disposed in any wellbore equipment at the surface or downhole. The signal carrier 66 may also be fixed inside or outside of the non-rigid string 16. The signals may be transmitted between the signal carrier 66 and the signal relay devices 60 using a suitably configured connector 70. The connector 70 may form a physical connection between the rigid string 14 and the non-rigid string 16 and also house electronics, communication modules and processing equipment to exchange signals between the carrier 66 and the signal relay devices 60.

In some embodiments, signal exchange speed and bandwidth can be enhanced by continuous system analysis and consequent shift to the best fit configuration channel selection by the system (pre-programmed and autonomous) and the use of Ultimate Radio System Extension Lines (URSEL). An illustrative URSEL system may be already installed at the rig site and/or installed into the wellbore. For example, a signal carrier such as a fiber optic wire may be embedded in the cement used to set casing 15. The wellbore construction equipped with signal exchange equipment/modules as mentioned may use the embedded signal carrier to transmit and receive information-bearing signals. In embodiments, radio over fiber (RoF) technology may be used to transmit information. Rof technology modulates light by radio signal and transmits the modulated light over an optical fiber. Thus, RF signals may be converted to light signals that are conveyed over fiber optic wires for a distance and then converted back to RF signals.

At the surface, the communication system 200 includes a controller 202 in signal communication with the signal relay devices 60. The controller 202 may include suitable equipment such as a transceiver 204 to wirelessly communicate with the signal relay devices 60 using EM or RF waves 206. This system 200 allows continuous communication while drilling and making and breaking jointed connections. The same RF transmitter or transceiver might be used for rig side and down hole transmission of the signals to reduce the complexity of the used equipment. Signal shape and strength might be adjusted depending on operational environment only.

The communication system 200 may be used to exchange information with the sensors and devices at the BHA 20 or positioned elsewhere on the string 11. Illustrative sensors include, but are not limited to, sensors for estimating: annulus pressure, drill string bore pressure, flow rate, near-bit direction (e.g., BHA azimuth and inclination, BHA coordinates, etc.), temperature, vibration/dynamics, RPM, weight on bit, whirl, radial displacement, stick-slip, torque, shock, strain, stress, bending moment, bit bounce, axial thrust, friction and radial thrust. Illustrative devices include, but are not limited to, the following: one or memory modules and a battery pack module to store and provide back-up electric power, an information processing device that processes the data collected by the sensors, and a bidirectional data communication and power module ("BCPM") that transmits control signals between the BHA 20 and the surface as well as supplies electrical power to the BHA 20. The BHA 20 may also include processors programmed with instructions that can generate command signals to operate other downhole wellbore equipment. The commands may be generated using the measurements from downhole sensors such as pressure sensors.

Based on information obtained using the communication system 200, the system 10 may be used to control out-of-norm wellbore conditions using well control equipment positioned in the wellbore 13. The well control equipment may include an annulus flow restriction device 222 that hydraulically isolates one or more sections of a wellbore by selectively blocking fluid flow in the annulus 37, a bore flow restriction device 224 that selectively blocks fluid flow along a bore of the drill string 11, and a bypass valve 250.

The annulus flow restriction device 222 may be positioned along an uphole section of a non-rigid string 16 or anywhere along the drill string 11. In one embodiment, the annulus flow restriction device 222 may form a continuous circumferential seal against a wellbore wall that controls flow in the well annulus 37. The terms seals, packers and valves are used herein interchangeably to refer to flow control devices that can selectively control flow across a fluid path by increasing or decreasing a cross-sectional flow area. The control can include providing substantially unrestricted flow, substantially blocked flow, and providing an intermediate flow regime. The intermediate flow regimes are often referred to as "choking" or "throttling," which can vary pressure in the annulus downhole of the annulus flow restriction device 222. The fluid barrier provided by these devices can be "zero leakage" or allow some controlled fluid leakage. In some embodiments, the seals and valves may include suitable electronics in order to be responsive to control signals. Suitable flow control devices include packer-type devices, expandable seals, solenoid operated valves, hydraulically actuated devices, and electrically activated devices.

Figure 4:
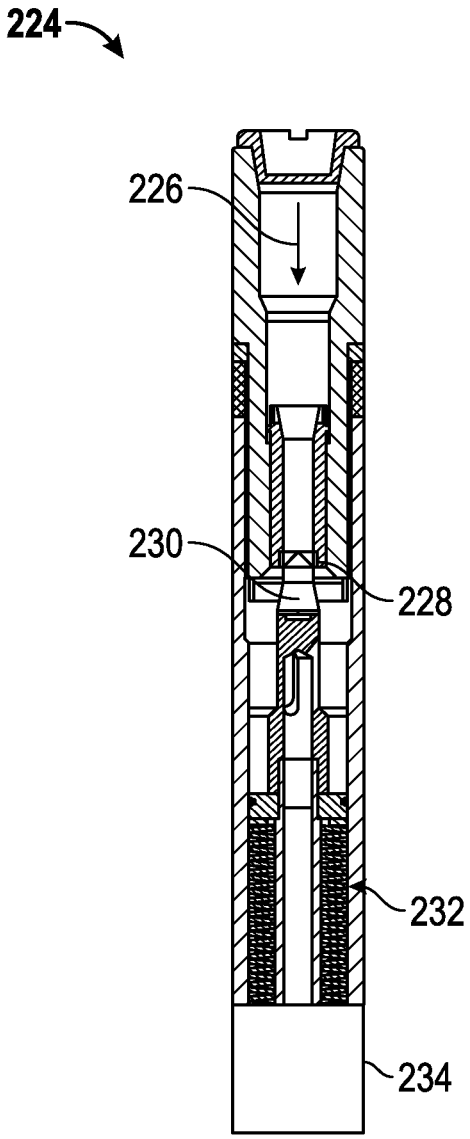
FIG. 4 schematically illustrates a bore flow restriction device that may be used with the FIG. 1 system.

Referring to FIG. 1, the bore flow restriction device 224 may be at the uphole end of a non-rigid string 16. Alternatively or additionally, the bore flow restriction device 222 may be positioned in the rigid section 14 of the drill string 11. Referring now to FIG. 4, the bore flow restriction device 224 may include a flow path 226, a sealing member 228, a closure member 230, a biasing member 232, and a signal responsive actuator 234. The sealing member 228 and the closure member 230 may be complementary in shape such that engagement forms a fluid-tight seal along the flow path 226. The biasing member 232 is configured to bias the closure member 230 toward and against the sealing member 230. In one embodiment, the biasing member 232 may include spring members (e.g., disk springs or coil springs). The spring force of the biasing member 232 may be selected such that a preset value or range of flow rates or pressure will overcome the spring force and keep the closure member 230 in the open, unsealed position. A drop in flow rate or pressure below the range allows the biasing member 232 to urge the closure member 230 into sealing engagement with the sealing member 228 (the closed position). Thus, the bore flow restriction device 22 may be configured to close in response to an interruption in fluid flow and/or a backflow condition. A backflow condition may arise with the bore pressure downhole of the bore flow restriction device 224 is greater than the uphole bore pressure.

The signal responsive actuator 234 allows the bore flow restriction device 224 to be remotely actuated with a control signal. The signal may be transmitted from the surface and/or from a device located in the wellbore 13 (e.g., the BHA 20). For instance, the controller 202 (FIG. 1) may transmit a control signal to instruct the bore flow restriction device 224 to open, close, or shift to an intermediate position. The actuator 234 may be a hydraulic, electric, or mechanical device that can shift the closure member 230 into engagement with the sealing member 228 in response to a control signal. The actuator 234 may include suitable electronics to process the control signals and initiate the desired actions. Like the annular flow restriction device 222, the bore flow restriction device 224 may either completely seal the bore or partially block fluid flow in the bore.

The bypass valve 230 is configured to direct flow between the annulus 37 and the bore of the drill string 13. Like the flow restriction devices 222, 224, the bypass valve 230 may include an actuator 234 that can shift the bypass valve 230 between an open position, a closed position, and/or an intermediate position. The actuator 234 may include suitable electronics to receive and process the control signals and to initiate the desired actions.

Referring now to FIGS. 1-4, exemplary modes of use of the system 10 will be discussed. To begin, the non-rigid string 16 may be used to convey the BHA 20 into the wellbore 13. It should be noted that the drill string 11 does not require the non-rigid string 16. However, use of the non-rigid string 16 may reduce the number of pipe stands 12*a* and flow diverters 30 required to reach a desired target depth. When desired, the rigid string 14 may be connected to the non-rigid string 16 with the connector 70. Thereafter, the flow diverters 30 may be used to interconnect the sections of pipe 12*a* used to form the rigid string 14. As successive pipe joints 12*a* are added to the rigid string 14, the CCS 100 maintains a continuous flow of drilling fluid along the drill string 11. Thus, the pressure applied to the formation remains relatively constant. During drilling with the BHA 20, the drill bit 50 may be rotated by one or more of the downhole motor 28, the rotary power motor 26 positioned at the connector 70, and the top drive 24.

As drilling progresses, pressure sensors in the BHA 20 and elsewhere measure ambient wellbore pressure. These pressure measurements are transmitted uphole via the signal carrier 66 in the non-rigid string 16. The connector 70 receives the signals from the carrier 66 and generates corresponding wireless signals that may be received and transmitted by the signal relay devices 60 in the flow diverters 30. The wireless signals "hop" from one flow diverter 30 to the next until the signals are near the surface. When the wireless signals are at or near the surface, the antenna 204 receives these wireless signals and conveys the signals to the controller 202. Thus, in this manner, pressure information may be transmitted from a downhole location to the surface. It should be understood that non-pressure related information may also be transmitted in this manner.

It should be appreciated that the flow of pressure information is not interrupted when pipe 12*a* is added to or removed from the drill string 11. Specifically, because the data is transmitted wirelessly, breaks in physical connections along the drill string 11 will not affect signal transmission between the signal relays 60 and the controller 202.

In some instances, the received pressure information may be used to optimize the wellbore pressure. For example, to maintain the pressure applied to formation within a specified window (e.g., below fracture pressure and above pore pressure), the controller 202 may transmit control signals using the communication system 200 to the annular flow restriction device 222, the bore flow restriction device 224, and/or the bypass valve 250. In response, the flow restriction devices 222, 224 may "throttle" or "choke" fluid flow in the annulus and bore, respectively. The bypass valve 250 may divert a selected amount of drilling fluid from the drill string bore into the annulus. These types of flow control adjustment can increase and decrease fluid pressure in the annulus 37 and/or the bore of the drill string 11 as needed.

Because pressure information is being continuously transmitted by the communication system 200, pressure adjustments may be done in real time or near-real time. Therefore, deep drilling situations that have tight pressure windows and formations with changing formation pressure may be managed more efficiently because wellbore pressure management devices can be rapidly and accurately adjusted. Additionally, this enhanced control may enable drilling to be performed while the well is in an underbalanced pressure condition. In many instances, drilling in an underbalanced condition yields enhanced rates of penetration.

In other instances, the pressure information may indicate that corrective action may be needed to contain an undesirable condition. For example, the pressure information received may indicate that a potential "kick," or pressure spike. One exemplary response may include the controller 202 transmitting a control signal using the communication system 200 to the annular flow restriction device 222. In response, the flow restriction device 222 may radially expand and seal against the adjacent wellbore wall. Thus, the annulus of the wellbore 13 downhole of the flow restriction device 222 may hydraulically isolated from the remainder of the wellbore 13. Additionally or alternatively, the controller 202 may send a control signal to the bore flow restriction device 224. In response, the bore flow restriction device 224 may seal the bore of the drill string 11. Thus, the bore of the drill string 11 downhole of the flow restriction device 224 may hydraulically isolated. The actuation of either or both of the flow restriction devices 222, 224 in this manner may isolate the downhole section of the wellbore 13 and thereby arrest the pressure kick.

After the wellbore has been isolated, remedial action may be taken such as bleeding off the pressure kick, increasing mud weight, etc. In other instances, it may be desired to isolate the wellbore either temporarily or permanently. Isolating the wellbore may be done by leaving the entire drill string 11 in the wellbore 13. Alternatively, the rigid string 14 may be disconnected from the non-rigid string 16 and pulled out the wellbore 13. Thus, the wellbore 13 is isolated by the non-rigid string 16 and the flow restriction devices 222, 224.

While the above modes have used surface initiated actions, it should be understood that the BHA 20 may use one or more downhole controllers that are programmed to also monitor pressure conditions, determine whether an undesirable condition exists, and transmit the necessary control signals to the flow restriction devices 222, 224, bypass valve 250, and/or other equipment. These actions may be taken autonomously or semi-autonomously.

As discussed above, the string 11 may be used for drilling the wellbore 13. Also, the string 11 may be used for non-drilling activities such as casing installation, liner installation, casing/liner expansion, well perforation, fracturing, gravel packing, acid washing, tool installation or removal, etc. In such configurations, the drill bit 50 may not be present.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. An apparatus for performing a wellbore operation, comprising:

a drill string configured to be disposed in a wellbore, the drill string including a rigid tubular section formed of a plurality of jointed tubulars;

a plurality of flow diverters positioned along the rigid tubular section, each flow diverter having:

a radial valve controlling flow through a wall of the rigid tubular section; and a signal relay device configured to convey information-encoded signals; and at least one flow control device positioned along the drill string, the at least one flow control device being responsive to signals received via the signal relay device associated with the plurality of flow diverters.

2. The apparatus of claim 1, further comprising a continuous circulation device having at least a first fluid path in fluid communication with a top drive and a second fluid path, wherein the at least one valve of each flow diverter is configured to selectively couple to the second fluid path; and a surface communication system in signal communication with the signal relay devices while one flow diverter of the plurality of flow diverters is coupled to the second fluid path, the surface communication system being configured to one of: (i) transmit information into the wellbore via the signal relay device, and (ii) receive information from the wellbore via the signal relay device.

3. The apparatus of claim 2, wherein the continuous circulation includes:

a fluid line receiving a drilling fluid from a drilling fluid source; and a manifold connected to the fluid line, the manifold selectively flowing the drilling fluid to the first and the second flow paths.

4. The apparatus of claim 1, wherein each flow diverter includes a second valve configured to selectively block flow along an axial bore of the drill string.

5. The apparatus of claim 1, wherein each signal relay device is configured to wirelessly transmit and receive electromagnetic signals.

6. The apparatus of claim 1, further comprising a surface controller configured to one of: (i) transmit information into the wellbore via the signal relay device, and (ii) receive information from the wellbore via the signal relay device.

7. The apparatus of claim 1, wherein the at least one flow control device is a flow restrictor connected to the drill string, the flow restrictor having a variable outer diameter for selectively restricting flow along an annulus of a wellbore.

8. The apparatus of claim 7, further comprising a flow bypass selectively flowing a fluid between a bore of the drill string and a wellbore annulus, the flow bypass and the adjustable flow restrictor cooperating to control a pressure in a selected section of the wellbore.

9. The apparatus of claim 1, wherein the drill string including a non-rigid tubular section formed of a continuous tubular, the non-rigid tubular section being connected to the rigid tubular section.

10. The apparatus of claim 9, further comprising a communication device that includes a data carrier positioned along the non-rigid tubular section, wherein the data carrier is one of (i) a metal conductor, and (ii) an optical fiber, and wherein the data carrier is positioned at one of (i) outside of the non-rigid string, (ii) inside the non-rigid string, and (iii) embedded in a wall of the non-rigid string.

11. The apparatus of claim 1, further comprising a communication system positioned at a surface location, the communication system including an antennae in signal communication with a radio extension line disposed in the wellbore.

12. A method for performing a wellbore operation using a drill string that includes jointed tubulars, comprising:

adding a plurality of flow diverters to the drill string, wherein each flow diverter has: (i) a valve controlling radial flow through a wall of the drill string, and (ii) a signal relay device configured to relay signals;

conveying the drill string along a wellbore: and transmitting signals along the drill string using the signal relay devices while a jointed tubular is one of: (i) added to the drill string, and (ii) removed from the drill string.

13. The method of claim 12, further comprising:

continuously circulating a drilling fluid through the drill string using the flow diverters; and communicating with at least one flow control device positioned along the drill string, the at least one flow control device being responsive to signals received via the signal relay devices; and controlling a pressure in the wellbore using the at least one flow control device while the jointed tubular is one of: (i) added to the drill string, and (ii) removed from the drill string.

14. The method of claim 12, further comprising:

estimating a pressure parameter at a selected location in the wellbore; and controlling a pressure at the selected location using the estimated pressure parameter.

15. The method of claim 14, wherein the pressure is controlled by one of: (i) adjusting a size of a cross-sectional flow path along a wellbore annulus, (ii) diverting fluid flow from a bore of the drill string to the wellbore annulus, and (iii) diverting flow from the wellbore annulus to the bore of the drill string.

16. The method of claim 12, wherein the signals are conveyed along the continuous tubular using a data carrier, wherein the data carrier is one of (i) a metal conductor, and (ii) an optical fiber, and wherein the data carrier is positioned at one of (i) outside of the non-rigid string, (ii) inside the non-rigid string, and (iii) embedded in a wall of the non-rigid string.

17. The method of claim 12, further comprising circulating a drilling fluid into an annulus of a wellbore, and returning the drilling fluid to the surface via a bore of the drill string.

18. The method of claim 12, wherein the signals wirelessly hop along the flow diverters.

19. A system for performing an adaptive and real time flow circulation control in a wellbore, comprising:

a drill string configured to be disposed in a wellbore, the drill string including a rigid tubular section formed of a plurality of jointed tubulars;

at least one flow diverter positioned along the rigid tubular section, the at least one flow diverter having:

a radial valve selectively flowing fluid between an interior and an exterior of the at least one flow diverter, and a signal relay device configured to exchange information-encoded signals;

at least one flow control device positioned along the drill string; and a communication system associated with the drill string and providing signal transmission to the at least one flow control device using the signal relay device.

20. The system of claim 19, wherein the communication system is configured to control flow circulation in the wellbore using the at least one flow control device while the jointed tubular is one of: (i) added to the drill string, and (ii) removed from the drill string.

* * * * *